US005975430A

United States Patent [19]

Larsen

[11] Patent Number: 5,975,430

[45] Date of Patent: Nov. 2, 1999

[54] SPRINKLER DEVICE

[75] Inventor: Donald R. Larsen, American Fork, Utah

[73] Assignee: Aspen Earth, Murray, Utah

[21] Appl. No.: 09/095,440

[22] Filed: Jun. 10, 1998

[51] Int. Cl.[6] ..... B05B 3/02; B05B 15/10

[52] U.S. Cl. ..... 239/205; 239/206; 239/239

[58] Field of Search ..... 239/200, 201, 239/203–206, 225.1, 227, 236, 237, 239, 242

[56] References Cited

U.S. PATENT DOCUMENTS

| | | | |
|---|---|---|---|
| 1,755,455 | 4/1930 | Nelson . | |
| 3,437,271 | 4/1969 | Hammelmann | 239/242 X |
| 3,523,647 | 8/1970 | Radecki . | |
| 3,567,127 | 3/1971 | Raumaker . | |
| 3,854,664 | 12/1974 | Hunter . | |
| 4,019,686 | 4/1977 | Palma . | |
| 4,162,038 | 7/1979 | Ridgway . | |
| 4,181,259 | 1/1980 | Ridgway . | |
| 4,466,142 | 8/1984 | Gould | 239/206 X |
| 4,509,636 | 4/1985 | Larsen . | |
| 4,534,510 | 8/1985 | Rinkewich . | |
| 4,651,925 | 3/1987 | Harris . | |
| 4,681,259 | 7/1987 | Troup et al. | 239/206 |
| 4,789,101 | 12/1988 | Kempf | 239/206 X |
| 4,895,305 | 1/1990 | Powell . | |
| 4,986,474 | 1/1991 | Schisler et al. . | |
| 5,010,908 | 4/1991 | McLeod et al. . | |
| 5,048,758 | 9/1991 | Jackerson | 239/239 |
| 5,107,717 | 4/1992 | Jackerson . | |
| 5,248,093 | 9/1993 | Pleasants . | |
| 5,366,157 | 11/1994 | Pleasants . | |

*Primary Examiner*—Lesley D. Morris
*Attorney, Agent, or Firm*—Thorpe, North & Western, LLP

[57] ABSTRACT

A sprinkler device has a helical track and a tracking element coupled between a reciprocating piston and a rotating head or nozzle to convert the reciprocal linear motion of the piston to rotation motion of the head or nozzle. A sprinkler housing defines a chamber for receiving the reciprocating piston. A sprinkler head is rotatably disposed on the housing and has a shaft extending into a cavity of the piston. The helical track is formed in the exterior surface of the shaft. Water is channeling into the chamber causing the piston to move in a linear direction. A tracking element formed on the piston engages the track and forces the shaft, and thus the head, to rotate. A return mechanism is coupled to the head and engages a valve to control the channeling of the water about the piston, causing the piston to reciprocate. An adjustable valve controls the flow of the water about the piston, and thus the rotational speed of the head. A primary stream of water is directed from the head towards a distal perimeter zone, while a secondary stream of water exhausted from the chamber is directed through a secondary nozzle towards a local perimeter zone.

32 Claims, 9 Drawing Sheets

SPRINKLER DEVICE

BACKGROUND OF THE INVENTION

1. Field of the Invention

The present invention relates to a reciprocating or oscillating sprinkler device for dispersing pressurized water for plant life. More particularly, the present invention relates to a sprinkler device having a reciprocating piston which is driven by the pressure of the water coupled to a helical track on a shaft of a sprinkler head such that the reciprocal linear motion of the water driven piston is converted to a reciprocating rotational motion of the head, thereby dispersing the water.

2. Prior Art

Automatic, underground sprinkler systems have been used for many years as an easy way to dispense water over plant life, such as lawns, gardens, and flower beds. These systems have a plurality of sprinklers, or sprinkler heads, disposed about the area to be watered. The sprinklers are located to provide even coverage of the area and conserve water. In addition, these sprinklers are grouped together in zones. A network of underground pipes couples together each sprinkler in a zone. These zones, or group of sprinklers, are coupled to a main water line by a valve manifold comprising a plurality of valves, one for each zone. The valves are electrically coupled to a timer which is programed to actuate the valves at a desired time and for a desired duration.

These sprinklers typically seek to achieve a number of common, important goals, namely water conservation, even coverage or even spay patterns, ease of use, and reliability. Conservation of water is usually achieved by sprinkler and sprinkler system designs which disperse water only on the desired vegitation, such as the lawn, as opposed to walkways and driveways. Water is also conserved by nozzle designs which do not mist or spray water too high so that it is carried away by the wind. Even coverage is usually achieved by sprinkler and sprinkler system designs which disperse water evenly so that there are no dry spots or puddles.

Reliability is often difficult to achieve. Simple sprinklers, with few components and few moving parts, have fewer components to fail, but may not obtain the desired performance features, such as even spray patterns or spray distance. More complex sprinklers have better performance characteristics, such as more even coverage and further spray distances, but also have more parts to fail.

Many different types of sprinklers have been devised for dispersing water over plant life. Many of these sprinklers utilize the water itself for operating the motion of the sprinkler. These sprinklers have evolved over time from simple devices to more complex devices. Some sprinklers utilized the pressure of water to elevate a portion of the sprinkler having a nozzle out of the ground, and the weight of the elevated portion to return it into the ground. Other sprinklers were designed with springs to return the nozzle into the ground. "Impact heads" were developed which used a weighted arm, swung by the force of the water, to turn the head as the arm returns, and complicated switching devices to repeatedly alter the direction of the head. "Gear drives" were developed which used the movement of the water through the head to turn an impeller, which in turn was coupled to a number of gears to turn the nozzle.

One disadvantage with some of these sprinklers, such as impact heads and gear drives, is that their moving parts may become clogged by debris in the water. In addition, they have many parts which means more components subject to failure. For example, the gear drive has numerous gears in which debris may be lodged, stopping the head. As another example, the swing arm of the impact head, or its switch mechanism, may become caked with dirt, impeding the motion of the head.

Another disadvantage with some of these sprinklers, such as gear drives, is that they may not be disassembled or serviced. Because of the many components in these sprinklers, they are often manufactured such that they may not be disassembled for servicing. For example, the many gears and turbines in a gear drive sprinkler are often disposed in a housing which is glued or sonic welded together, which prevents opening the housing and access to the components. Another disadvantage with these sprinklers is their cost. The complexity makes them more expensive to replace.

The problem with reliability is aggravated by the typical location of the sprinkler in the ground and surrounded by dirt and sod. If a sprinkler fails, the sod and dirt surrounding the sprinkler often must be removed to uncouple the sprinkler from the system. With the sprinkler removed, dirt easily accumulates around pipe threads of the system and is introduced into the pipes forming the system. Replacing the sprinkler is difficult because the dirt must be cleared from the pipe threads. In addition, the dirt now in the pipe may clog the new sprinkler.

Other sprinklers have been proposed which use the pressure of the water to drive a system for dispensing the water. U.S. Pat. No. 4,509,686, issued Apr. 9, 1985, to Larsen, the same inventor of the present invention, discloses a piston slidably disposed in a housing. A rack and pinion is coupled between the piston and the housing to rotate the housing with a nozzle therein. This sprinkler advantageously utilizes the pressure of the water to drive the reciprocating piston and convert the linear motion of the piston to rotation motion of the nozzle. Despite this advantage, the need for simpler, more reliable sprinklers exists.

Other sprinklers have been proposed. For example, U.S. Pat. No. 5,048,758, issued Sep. 17, 1991, to Jackerson, and U.S. Pat. No. 5,107,717, issued Apr. 28, 1992, to Jackerson, disclose a sprinkler with a piston slidably disposed in a housing. A barrel type indexing cam is formed integrally with the piston. The cam has staggered, opposing triangular shapes formed thereon defining similar staggered, opposing recesses. A pin is formed in the housing and extends into the recess. As the piston, and thus the cam, moves up and down, the pin abuts the triangular shape forcing the cam, and thus the piston to rotate. The piston is rotatably fixed with respect to a shaft on which is disposed a nozzle.

U.S. Pat. No. 4,895,305, issued Jan. 23, 1990, to Powell, discloses a piston slidably disposed in a housing. A rack and pinion system is disposed between the piston and a nozzle to rotate the nozzle. U.S. Pat. No. 3,567,127, issued Mar. 2, 1971, to Raumaker et al., discloses a fixed piston in a head which moves up and down. As the head moves downwardly, an annular row of teeth formed on the head contact an annular row of inclined rubber fingers to impart slight partial rotation to the head.

Many of these sprinklers suffer from the same disadvantages as gear drive or impact heads in that they have numerous moving parts which are subject to failure or clogging. Another disadvantage with many of these sprinklers is that they rotate the nozzle in a series of discrete steps, as opposed to a continuous even motion. The result is uneven coverage and possible dry spots and puddling.

Another disadvantage with many of these sprinklers is that they dispense a main stream of water at a distance away from the sprinkler while neglecting the area immediately adjacent and surrounding the sprinkler. Thus, a plurality of sprinklers must be grouped together so that they overlap.

Another disadvantage is that they may not operate at low water pressures. Some of the sprinklers include springs which necessitate a minimum amount of water pressure in order to overcome the force of the spring. Another disadvantage with some of these sprinklers is that their operating speed, or rate of rotation, may not be adjusted.

Therefore, it would be advantageous to develop a sprinkler capable of evenly dispensing water over a large area. It would also be advantageous to develop a sprinkler with fewer parts to fail and assemble, and fewer moving parts to become clogged. It would also be advantageous to develop a sprinkler capable of smooth, continuous motion, and even coverage. It would also be advantageous to develop a sprinkler capable of operating over a range of water pressures, including low pressure. It would also be advantageous to develop a sprinkler capable of adjustable speed or rate of rotation.

OBJECTS AND SUMMARY OF THE INVENTION

It is an object of the present invention to provide a sprinkler that evenly dispensing water over a large area.

It is another object of the present invention to provide a sprinkler with fewer parts and fewer moving parts.

It is yet another object of the present invention to provide a sprinkler with smooth, continuous, motion, and even coverage.

It is yet another object of the present invention to provide a sprinkler which operates over a range of water pressures, including low pressure.

It is a further object of the present invention to provide a sprinkler with an adjustable speed or rate of rotation.

These and other objects and advantages of the present invention are realized in a sprinkler device having a piston driven by the pressure of the water in a reciprocal linear motion, and a helical track and tracking element for converting the reciprocal linear motion of the piston to a reciprocating rotational motion to turn a nozzle or head.

The sprinkler device has a sprinkler housing which may be disposed on the ground or slidably disposed in another housing which is in the ground such that the sprinkler housing protrudes therefrom. The housing is rotationally fixed and longitudinally fixed except as it may protrude from the other housing. The sprinkler housing defines a fluid channel for channeling water through and about the housing. The housing also defines a chamber therein. The piston is slidably disposed within the chamber and is longitudinally movable, but rotationally fixed. The piston has a body portion defining a cavity.

A sprinkler head is rotatably disposed on the sprinkler housing and has a nozzle for dispersing the water. The head is otherwise fixed with respect to the housing. A shaft is coupled to the sprinkler head and extends therefrom into the housing and into the cavity of the piston. The shaft rotates with the head, but is longitudinally fixed with respect to the housing. The shaft is slidably disposed within the cavity of the piston, and thus the shaft and piston are longitudinally moveable with respect to each other. In addition, the shaft is rotatably disposed in the cavity of the piston, and thus the shaft and piston are rotatably moveable with respect to each other.

A helical track advantageously is formed on an exterior surface of the shaft. A tracking element advantageously is formed on the piston, or body portion of the piston, and extends into the track. Thus, as the piston and shaft move with respect to one another, longitudinally and rotatably, the tracking element moves or slides within the helical track. Because the piston is rotatably fixed with respect to the housing, the shaft rotates as the piston moves longitudinally. Therefore, the helical track and tracking element advantageously convert the linear reciprocal motion of the piston to rotational motion of the shaft, and thus the head and nozzle.

The piston divides the chamber of the housing into first and second chambers. Passages are formed between the chambers and the fluid channel to allow water to enter and exit the chambers. The piston also has a first surface communicating with the first chamber and an opposite second surface in communication with the second chamber. The second surface has a greater effective surface area than an effective surface area of the first surface. Thus, equal water pressure on both sides of the piston, or in both chambers and acting on both surfaces, causes the piston to move in a first linear direction towards the first chamber.

A valve is formed in the fluid channel and has two positions, open and closed. A return actuator is coupled to the head or shaft and engages the valve. As the head and shaft turn, the return actuator either opens or closes the valve. Thus, as the head turns in a first rotational direction, the valve is closed and the water pressure on either side of the piston is the same. Similarly, as the head turns in a second rotation direction, opposite the first, the valve is open, allowing water to escape from the second chamber. As water escapes from the second chamber the water pressure in the second chamber drops, allowing the piston to move in a second linear direction, opposite the first.

An adjustable valve advantageously is disposed in the fluid channel. The adjustable valve selectively and adjustably restricts the flow through the fluid channel and into the second chamber. Therefore, the adjustable valve advantageously controls a rate at which fluid flows into the second chamber and a speed at which the piston moves in the first direction, and thus a rotational speed of the head or nozzle.

The helical track formed in the shaft has a helix angle which may be varied as desired. For example, the helix angle may be steep, or large, to obtain greater torque, but less rotational travel. As another example, the helix angle may be small to obtain more rotational travel, but less torque. In addition, the helix angle may vary along the length of the shaft as desired. For example, the helix angle at ends of the shaft may be great while the helix angle in middle of the shaft is small. Thus providing greater torque at the beginning of the piston travel or stroke to overcome friction.

These and other objects, features, advantages and alternative aspects of the present invention will become apparent to those skilled in the art from a consideration of the following detailed description taken in combination with the accompanying drawings.

DETAILED DESCRIPTION OF THE INVENTION

Reference will now be made to the drawings in which the various elements of the present invention will be given numerical designations and in which the invention will be discussed so as to enable one skilled in the art to make and use the invention.

Figure 1:
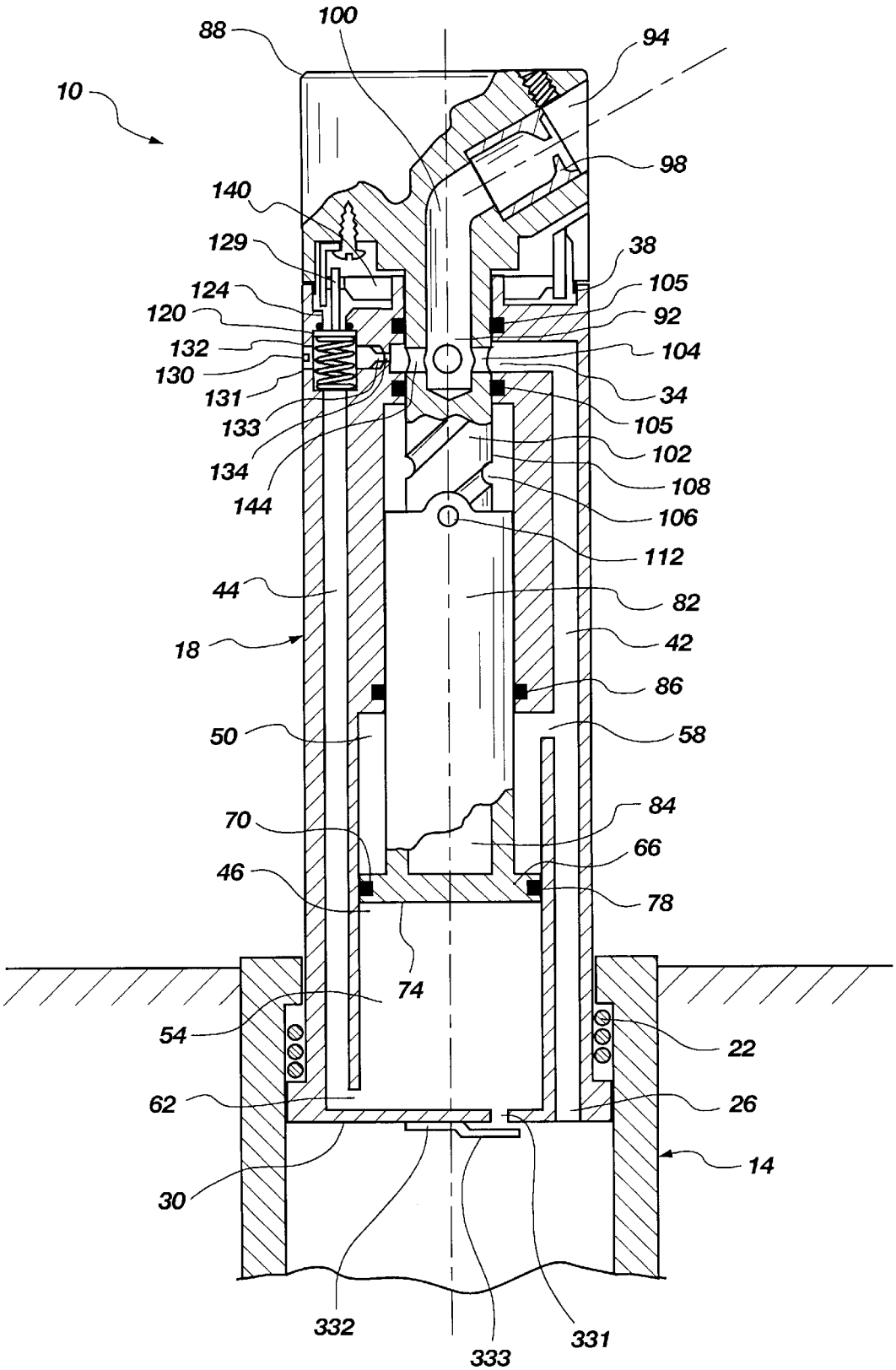
FIG. 1 is a partial cut-away view of a preferred embodiment of a sprinkler device of the present invention.

As illustrated in FIG. 1, a sprinkler device, indicated generally at 10, in accordance with the present invention is shown for dispensing pressurized water for plant life. The sprinkler device 10 will be described with particular reference to a "pop-up"-type, underground sprinkler head. Thus, the sprinkler device 10 has an outer sprinkler housing 14 configured for being disposed in the ground and having a threaded inlet (not shown) coupled to a threaded nipple (not shown) of an underground sprinkler pipe (not shown) conducting pressurized water, all of which is well known in the art. The sprinkler device 10 also has an elongated, inner sprinkler housing 18 slidably disposed within the outer housing 14 and configured for protruding from the outer housing 14 when pressurized water is introduced into the outer housing and bears against the inner housing. A spring 22 returns the inner housing 18 into the outer housing 14 when the pressurized water is removed from the outer housing.

It is of course understood that the principles of the present invention are equally applicable to above ground sprinklers, which may be disposed on the ground, as opposed to in the ground. In such above ground embodiments, the outer housing 14 may be omitted and the inner sprinkler housing 18 alone may form a primary sprinkler housing or sprinkler body disposed on the ground. The remaining discussion will be directed to the inner sprinkler housing 18 with the understanding that the inner housing may form part of a "pop-up"-type sprinkler or an above ground type sprinkler.

The elongated sprinkler housing 18 has a housing inlet 26 preferably located in a base or bottom 30 of the housing 18. The housing 18 also has a housing outlet 34 preferably located at a top 38 of the housing 18.

A housing fluid channel 42, or intermediate fluid passageway, is disposed between the inlet 26 and the outlet 34. The fluid channel 42 channels or conveys water through the sprinkler housing 18. The water enters the housing 18 through the inlet 26, flows through the fluid channel 42, and at least a portion of the water exits the housing 18 through the outlet 34, defining a primary fluid path. The shape or configuration of the fluid channel 42 may have various configuration for channeling the water through the housing 18. The channel 42 may extend generally linearly through the housing 18 from the inlet 26 to the outlet 34, as shown, but may also include other branches or paths. A secondary channel 44 may be defined by the housing 18 and extend from the top 38 of the housing 18 to the bottom 30 of the housing, defining a secondary fluid path.

The housing 18 defines a chamber or cavity 46 therein. The chamber 46 is configured for receiving and expelling the water. The chamber 46 may be divided into a first or upper chamber 50, and a second or lower chamber 54, as discussed more fully below. The housing defines a first fluid passage 58 disposed between the fluid channel 42 and the first chamber 50 for allowing water to flow into and out of the first chamber. The housing also defines a second fluid passage 62 between the fluid channel 42, or secondary channel 44, and the second chamber 54 for allowing water to flow into and out of the second chamber.

A reciprocating piston 66 is slidably disposed in the chamber 46, and thus the housing 18. The piston 66 divides the chamber 46 into the first chamber 50 and the second chamber 54. The piston 66 has a first or upper surface 70 in communication with the first chamber 50, and a second or lower surface 74 in communication with the second chamber 54. The piston 66 slides longitudinally, or along a longitudinal axis of the housing, but is rotationally fixed.

The piston 66 and chamber 46 may have non-circular, cross-sectional shapes, such as elliptical, to prevent the piston 66 from rotating within the chamber 46. The cross-sectional shapes being taken in a plane perpendicular to the longitudinal axis of the housing. Alternatively, a groove may be formed in a wall of the chamber 46 which receives a protrusion formed on the piston 66. Alternatively, a notch may be formed in the piston 66 which receives an elongated protrusion formed on the wall of the chamber 46. A seal 78 may be formed between a perimeter or periphery of the piston 66 and the wall of the chamber 46. The seal 78 and piston 66 seal the first and second chambers 50 and 54 from one another.

The piston 66 may have an elongated body portion 82 defining a cavity 84 therein. The elongated body portion 82 of the piston 66 is also slidably disposed in the housing 18. A seal 86 is formed around the body portion 82 of the piston 66 between the body portion 82 and the housing 18 to prevent water from leaking out of the first chamber 50 around the body portion.

A sprinkler head 88 is rotatably disposed on the housing 18, but is longitudinally fixed. The head 88 has a head inlet 92 in fluid communication with the housing outlet 34 so that the water flows from the housing 18 and into the head 88. The head also has a head outlet 94 for dispersing the water. The head 88 or outlet 94 may include a nozzle 98 for spraying the water. A head fluid channel 100 is disposed between the inlet 92 and the outlet 94 for channeling water through the head 88, also defining the primary fluid path. The head 88 and/or nozzle 98 is one example of a spray means for spraying the water.

An elongated shaft 102 is coupled to a bottom of the head 88 and extends therefrom into the housing 18. The shaft 102 also extends into the cavity 84 of the body portion 82 of the piston 66. The cavity 84 of the piston 66 slidably receives the shaft 102. The shaft 102 is rotatably disposed in the housing 18 and cavity 84 of the piston 66, but longitudinally fixed with respect to the housing 18. The piston 66 is longitudinally movably or slidable with respect to the shaft 102.

A portion of the head fluid channel 100 extends into the elongated shaft 102, and thus into the housing 18. The shaft 102 has an opening 104 formed therein between the housing outlet 34 and the head inlet 92. Thus, water is allowed to flow from the housing 18, or housing channel 42, and into the head 88, or head channel 100, through the opening 104 in the shaft. A pair of seals 105 are disposed around the shaft 102 and between the shaft 102 and housing 18 on either side of the opening 104 to prevent water from leaking.

A helical track or groove 106 advantageously is formed in an exterior surface 108 of the elongated shaft 102. A tracking element or protrusion 112 advantageously is formed on the body portion 82 of the piston 66 and engages, or extends into, the helical track 106. The tracking element 112 may be a rounded pin extending through a wall of the body portion 82, and into the cavity 84. Alternatively, the tracking element 112 may be a somewhat elongated, angled protrusion, such as a portion of a helical protrusion, to more closely mate with the helical track 106.

As the piston 66 slides longitudinally and linearly within the chamber 46, the cavity 84 of the piston 66 slides longitudinally and linearly with respect to the shaft 102. As the shaft 102 slides within the cavity 84, the tracking element 112 slides within the helical track 106. Because the tracking element 112 is fixed to the piston 66, or body portion 82 thereof, and disposed within the helical track 106, the shaft 102 is forced to rotate as the piston 66 slides. Therefore, the helical track 106 and tracking element 112 advantageously convert the linear reciprocal motion of the piston 66 to rotational motion of the shaft 102, and thus of the sprinkler head 88 and nozzle 98. The sprinkler device 10 preferably has a pair of helical tracks (only one shown) formed in the shaft 102 and intertwined with one another, or rotated 180 degrees with respect to one another. Likewise, the device 10 preferably has a pair of tracking elements (only one shown) formed on the piston 66 and generally opposing one another.

The helical track formed on the shaft 102 and the tracking element 112 formed on the piston 66 is one example of a rotating means for converting linear reciprocal motion of the piston 66 to rotational motion of the head 88 or nozzle 98. It is of course understood that the helical track and tracking element may be disposed between the piston 66 and head 88 in various other ways. For example, the head 88 may have an elongated body portion extending into the housing and defining a cavity therein. An elongated shaft may be formed on the piston and extend therefrom into the cavity of the body portion of head 88. The helical track may be formed on an exterior surface of the shaft of the piston and the tracking element formed on the head. In addition, the helical track may be formed on the inner surface of a cavity.

Figure 2A:
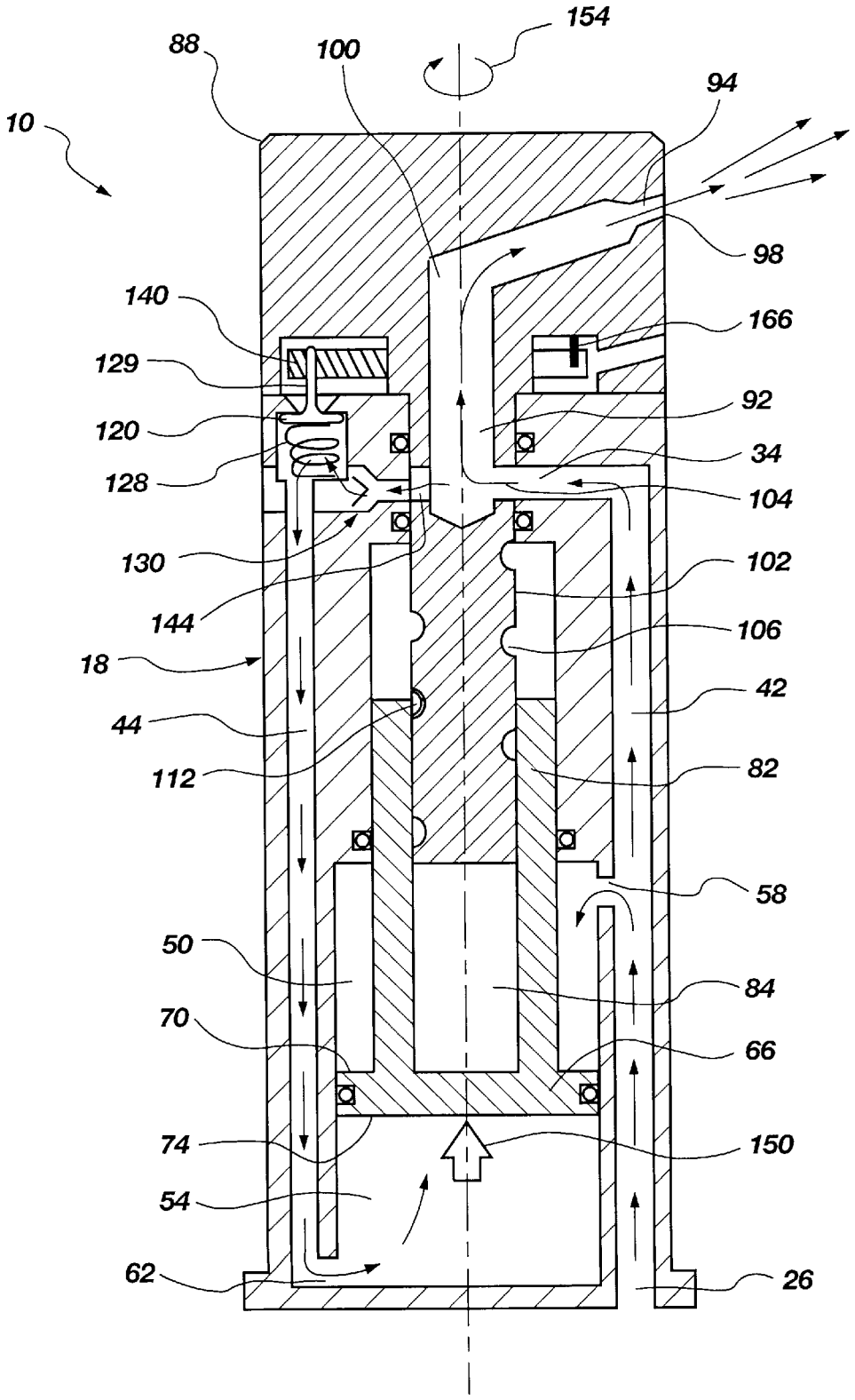
FIG. 2*a* is a cross sectional view of the preferred embodiment of the sprinkler device of the present invention.
Figure 2B:
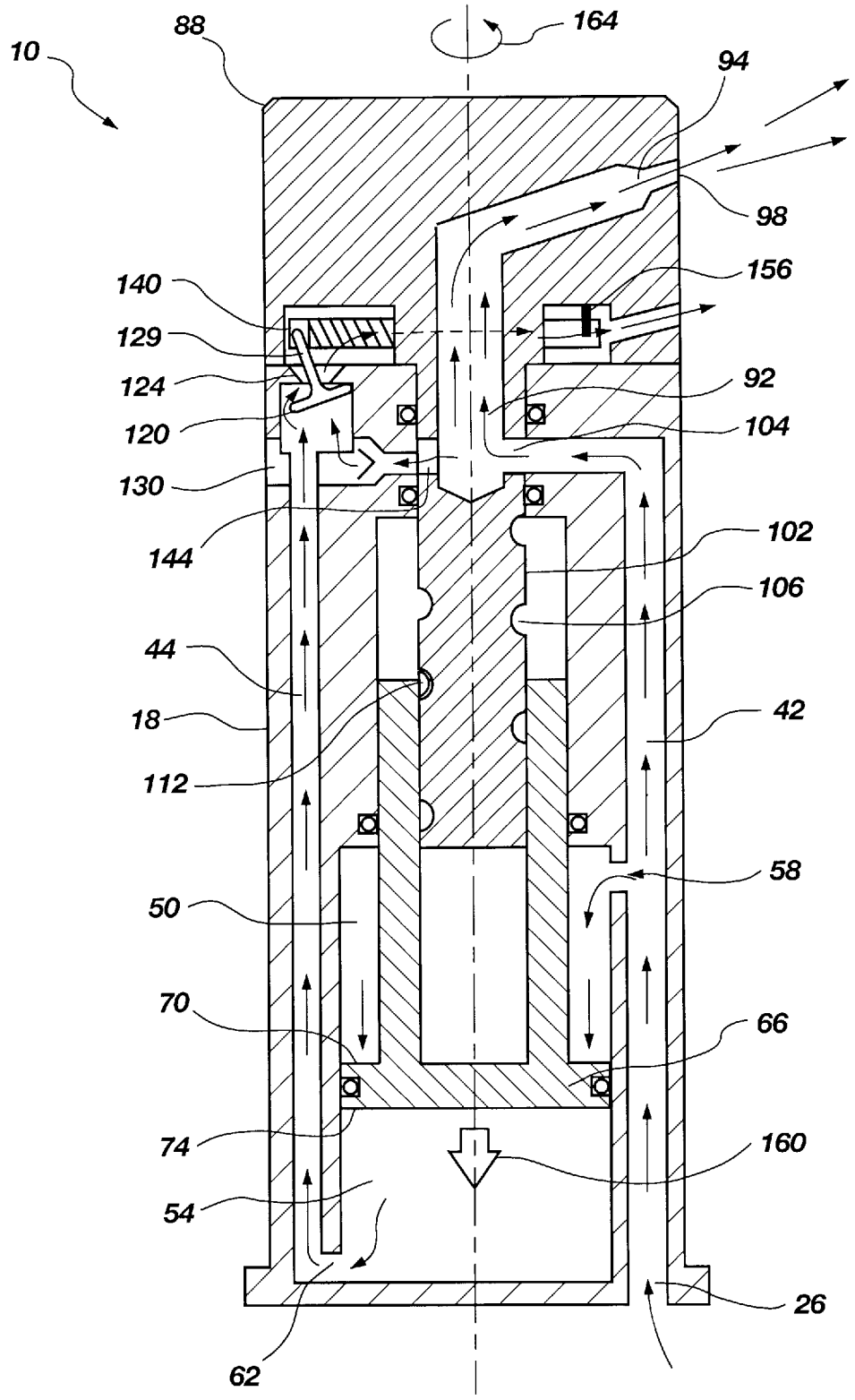
FIG. 2*b* is a cross sectional view of the preferred embodiment of the sprinkler device of the present invention.
Figure 2C:
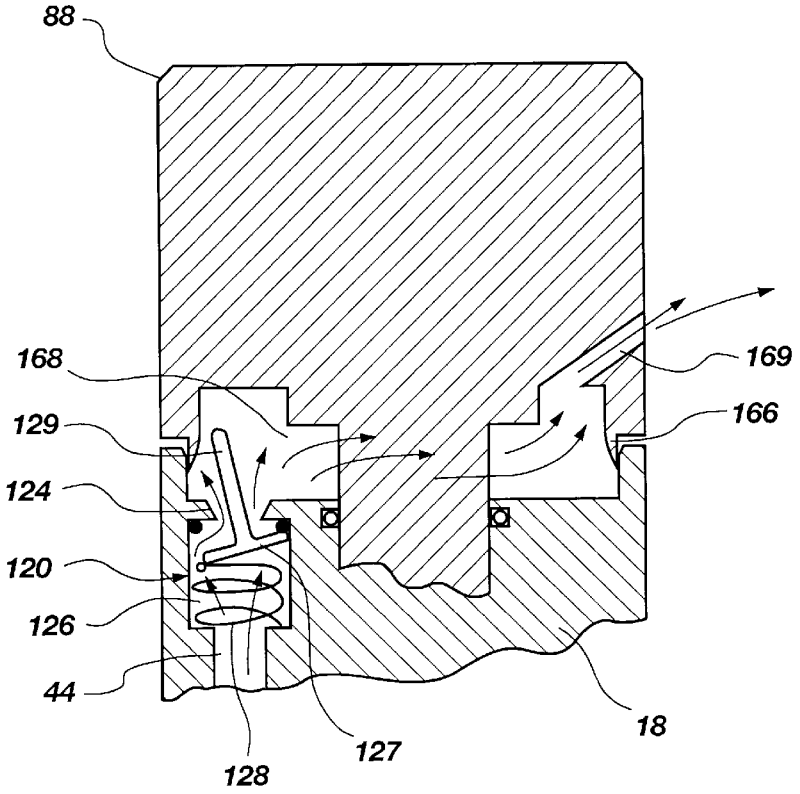
FIG. 2*c* is a cross sectional detail view of the preferred embodiment of the sprinkler device.

Referring to FIG. 2*c,* a valve 120 is disposed in the fluid channel 42 or secondary channel 44. The valve 120 has an opening 124 and releases water therethrough when open, but prevents water from passing through the opening 124 when closed. The valve 120 controls the direction of the water into and out of the second chamber 54, as discussed more fully below. The valve 120 generally operates between an open and a closed position. The valve 120 may have a cavity 126 in fluid communication with the fluid channel 42, or secondary channel 44. The opening 124 is formed in the cavity 126. The valve 120 may also have a plate 127 covering the opening 124 and biased against the opening by a spring 128, which is disposed in the cavity 126. A pin 129 extends from the plate 127 out of the cavity 126 for being engaged by an actuator as the head 88 turns, as discussed more fully below. The plate 127 may also be a ball. The valve 120 defines a primary valve.

Referring again to FIG. 1, an adjustable, secondary valve 130 advantageously is disposed in the fluid channel 42 or secondary channel 44. The adjustable valve 130 adjustably and selectively restricts the flow of water through the fluid channel 42 or secondary channel 44 and into the secondary chamber 54. Therefore, the adjustable valve 130 controls a rate at which the water flows into the second chamber 54, and thus a speed at which the piston 66 moves.

The adjustable valve 130 may be a screw type valve having a threaded portion 131 engaging a threaded bore 132 defined by the housing 18, and a protruding portion 133 extending into an orifice 134 in the fluid channel 42. By screwing the valve in or out, the protruding portion 133 is advanced or retracted from the orifice 134, thus increasing and decreasing the cross-sectional area of the fluid channel 42, or secondary channel 44.

The sprinkler device 10 also has a return actuator, generally indicated at 140, coupled to the head 88 or shaft 102 for reversing the directional movement of the piston 66. The return actuator 140 is coupled to the valve 120 for closing the valve 120 while head 88 rotates in a first rotation direction and opening the valve 120 while the head 88 rotates in a second rotational direction, opposite the first. In opening the valve 120, the return actuator 140 may engage the pin 129 extending from the plate 127 of the valve 120 to twist or angle the plate 127 so that water may escape through the opening 124 in the valve 120.

Therefore, as the head 88 rotates in the first rotational direction, the valve 120 is closed and the water pressure on either side of the piston 66 is the same. Similarly, as the head 88 rotates in the second rotation direction, opposite the first, the valve 120 is open, allowing water to escape from the second chamber 54. As water escapes from the second chamber 54, the water pressure in the second chamber 54 drops, allowing the piston 66 to move in a second linear direction, opposite the first.

The operation of the preferred embodiment of the sprinkler device 10 of the present invention is as follows. Water enters the external housing 14 and exerts pressure against the bottom 30 of the inner housing 18, forcing the inner housing 18 to protrude from the external housing 14.

Referring to FIG. 2*a,* the water enters the sprinkler housing 18 through the inlet 26 and flows through the fluid channel 42. Most of the water follows the primary fluid path directly through the fluid channel 42 and out the outlet 34. Most of the water continues to follow the primary fluid path through the opening 104 in the shaft 102, through the inlet 92 of the head 88, through the fluid channel 100 in the head 88, and out the outlet 98. The nozzle 94 has an opening shaped and sized to control the spray of the water as desired.

Some of the water passes through the first passage 58 and into the first chamber 50. Some of the water passes through another opening 144 in the shaft 102, or is diverted around the shaft, and into the secondary fluid channel 44. While the fluid channel 42, or primary fluid channel 42, channels water up and out of the housing 18, the secondary channel 44 channels water down the housing 18 and into the second chamber 54. In the secondary channel 44 the water passes through the valve 120, or the cavity 126 of the valve, and past the adjustable valve 130, or the orifice 134 of the adjustable valve.

This state of the sprinkler device 10 defines a pressure cycle. The pressure of the water is the same on both sides of the piston 66, or in both chambers 50 and 54. Because of the body portion 82 extending from the piston 66 at the first surface 70, the second surface 74 has a greater surface area, or effective surface area, than a surface area, or effective surface area, of the first surface 70. The effective surface area refers to a surface upon which the water pressure exerts a force in a single direction. For example, although the surfaces 50 and 54 of the piston 66 have the same diameter, or the piston 66 has a constant diameter, the first surface 50 has a portion thereof, defined by the body portion 82, against which the water pressure does not act. The result is that the water pressure, although equal on both sides of the piston 66, exerts a greater force against the second surface 54 because of its greater surface area. The greater force causes the piston 66 to move in the first linear direction, indicated by arrow 150, or upwardly.

As the piston 66 moves in the first linear direction, the shaft 102 is received within the cavity 84 of the body portion 82 of the piston 66. Because the tracking element 112 formed on the body portion 82 engages or projects into the helical track 106 formed in the shaft 102, the shaft 102 is caused to rotate in the first rotational direction, indicated by arrow 154. It should be noted that the helical track 106 may be formed in shaft 102 in either direction, left handed or right handed, as desired so that the first rotational direction 154 is either clockwise or counter-clockwise.

Referring to FIG. 2*b,* as the head 88 nears the end of its rotational travel, a pin 156 formed in the head 88 engages the return actuator 140, which in turn engages the pin 129 of the valve 120. The pin 156 of the head 88 essentially causes the return actuator 140 to rotate and open the valve 120 by twisting or angling the pin 129 attached to the plate 127 of the valve 120. Water escapes through the opening 124 in the valve 120 because the plate 127 has been moved away from the opening 124 by the return actuator 140.

Most of the water continues to be channeled through the housing 18 by the fluid channels 42 and 100 and dispersed by the nozzle 98 as described above. But with the valve 120 open, the water in the second chamber 54 is now allowed to flow out of the second chamber 54 through the second passage 62, up the secondary channel 44, and out the opening 124 in the valve 120. In addition, the water flowing from the fluid channel 42, through the openings 104 and 142 in the shaft, and into the secondary channel 44, is now diverted out of the secondary channel 44 by the open valve 120, and thus prevented from reaching the secondary chamber 54 and exerting a force on the second surface 74.

This state of the sprinkler device defines an exhaust cycle. The water pressure is now unequal on the sides of the piston 66. The water pressure in the first chamber 50 and acting on the first surface 70 is now greater than the water pressure in the second chamber 54 and acting on the second surface 74. The water pressure acting on the first surface 70 now exerts a greater force on the first surface 70 than the force exerted by the water on the second surface 74, despite the greater surface area of the second surface. The greater force of the water pressure on the first surface 70 causes the piston 66 to move in the second linear direction, indicated by arrow 160, or downwardly.

As the piston 66 moves in the second linear direction 160, the shaft 102 is withdrawn from within the cavity 84 of the body portion 82 of the piston 66. Because the tracking element 112 formed on the body portion engages or projects into the helical track 106 formed in the shaft 102, the shaft 102 is caused to rotate in the second rotational direction, indicated by arrow 164.

Referring to FIG. 2*a,* As the head 88 nears the end of its rotational travel, a pin 166 formed in the head 88 engages the return actuator 140, which in turn engages the pin 129 of the valve 120. The pin 166 of the head essentially causes the return actuator 140 to rotate and close the valve 120 by disengaging the pin 129 attached to the plate 127 of the valve 120. The spring 128 of the valve 120 pushes the plate 127 against the opening 124, thus preventing water from escaping.

The sprinkler device 10 of the present invention advantageously returns the piston 66 without the use of a spring. Therefore, the device 10 may be used with varying amounts of water pressure, including low pressure, because there is no minimum required pressure needed to overcome the spring force.

In addition, the head 88 and nozzle 94 of the sprinkler device 10 advantageously may return quickly, or rotate faster in the second direction due to the differently sized effective surface areas of the surfaces of the piston. The quick return of the head 8 prevents puddling at the ends of the rotational travel. Other rotating sprinklers, such as gear drives, tend to move more slowly and pause at the ends of rotational travel, causing puddling.

Referring now to FIG. 2*c,* an annular cavity 168 is formed between the head 88 and the housing 18. As water exits the valve 120 through the opening 124, it enters the annular cavity 168. An outlet 169 is formed in the head 88 and is in fluid communication with the annular cavity 168, and defines a secondary head outlet. The water flows from the cavity 168 and out the outlet 169. The outlet 169 may include a nozzle, defining a secondary nozzle.

Figure 2D:
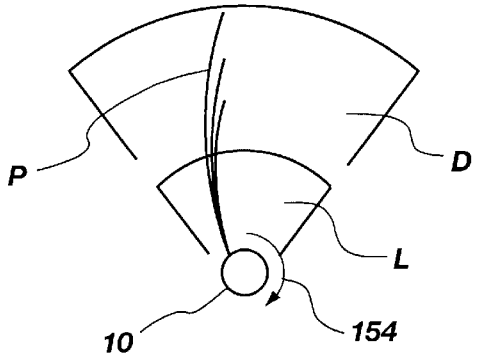
FIG. 2*d* is a top view of the preferred embodiment of the sprinkler device illustrating a spray pattern.
Figure 2E:
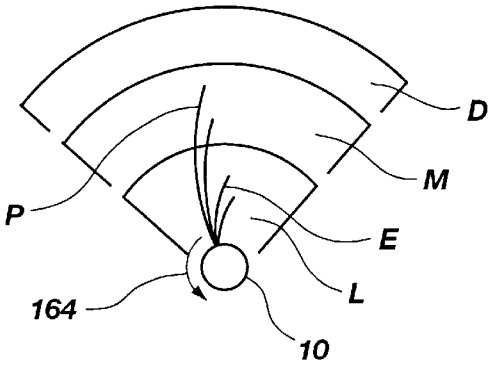
FIG. 2*e* is a top view of the preferred embodiment of the sprinkler device illustrating a spray pattern.

The water exiting the head 88 through the secondary outlet 169 may be directed to an area more closely surrounding the sprinkler device 10, defining a local perimeter zone L, as opposed to a more distant area away from the sprinkler device 10 and outside of the local perimeter zone, defining a distal perimeter zone D, as shown in FIGS. 2*d* and 2*e*. Referring to FIG. 2*d,* as the device 10 rotates in the first direction 154 during the pressure cycle, water is sprayed from the nozzle in a primary stream P towards the distal perimeter zone D. Referring to FIG. 2*e,* as the device 10 rotates in the second direction 164 during the exhaust cycle, water is sprayed form the nozzle in the primary stream P towards the distal perimeter D as before, but water is also sprayed through the secondary nozzle in a secondary stream E towards the local perimeter zone L. As discussed above, the head may rotate faster in the second direction, or return quickly during the exhaust cycle. Thus, the stream of water from the primary nozzle 94 tends to fall short of the distal perimeter zone D and is sprayed towards an area between the distal perimter zone D and the local perimeter zone L, defining an intermediate zone M.

The water flowing through the secondary outlet 169 includes the water expelled from the second chamber 54 by the piston 66 and the water that flows into the secondary channel 44 from the primary fluid channel 42, as shown in FIG. 2*b*. This amount of water will typically be less than the water flowing out the primary nozzle 98 in the head 88, and thus is well suited for the smaller, local perimeter zone. In this way, the secondary outlet 169 advantageously disperses water near the device 10 itself, reducing the need for the overlapping spray patterns of numerous sprinklers to obtain even coverage. Thus, the nozzle 98 and the secondary nozzle 169 may have different orientations or be directed to different areas. In addition, the sprinkler device 10 of the present invention may be configured by adjusting the nozzle orientation and rotational speed of the head to disperse water over two or three different zones.

A thin annular protrusion 166 is formed on the bottom of the head 88 along the outside of the annular channel 168. The annular protrusion 166 is received with the annular channel 168 and abuts an outer wall of the housing 18 which forms the annular channel 168. The pressure of the water forces the protrusion 166 to press against the wall, forming a seal between the head 88 and housing 18 to prevent water from leaking.

Figure 3:
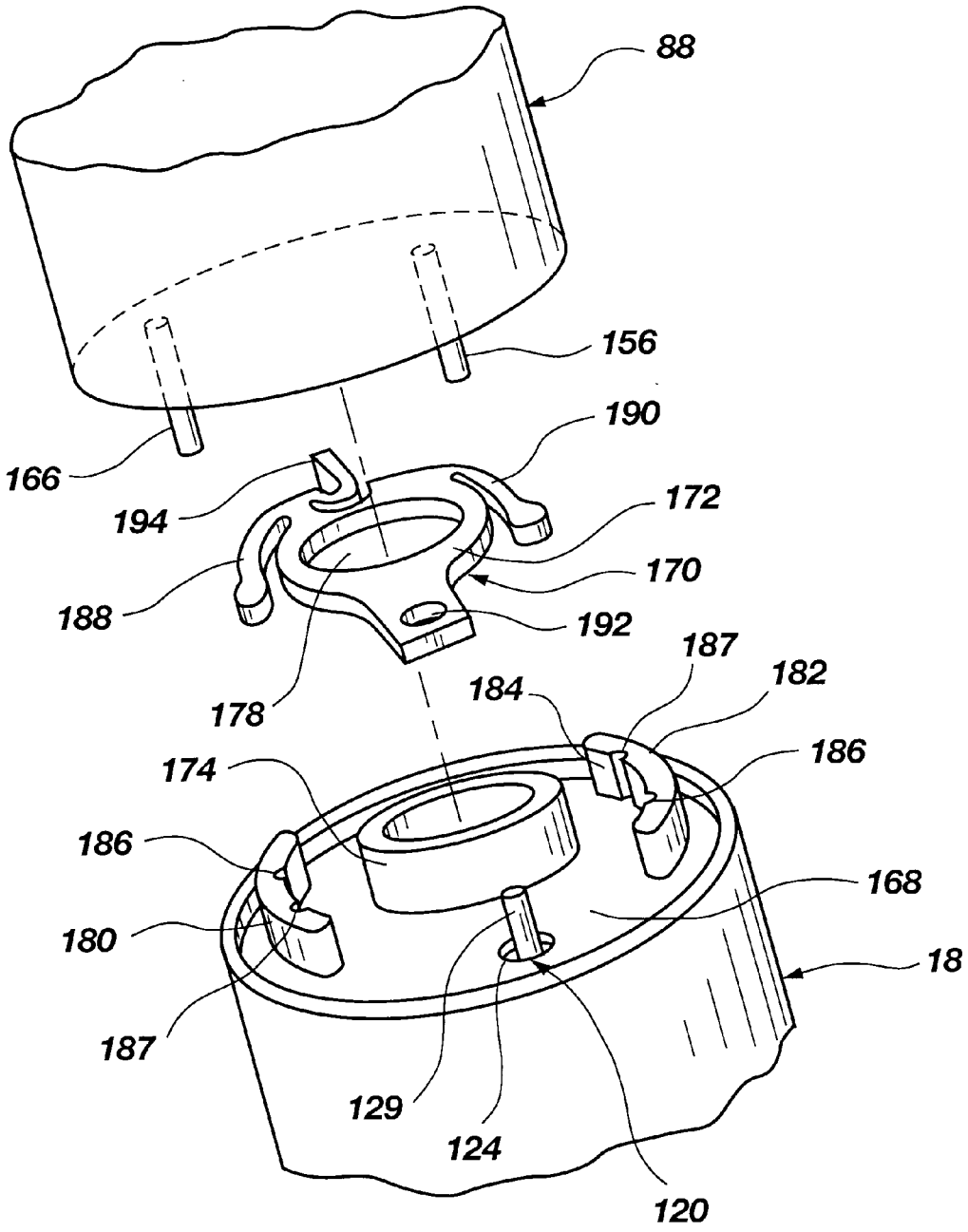
FIG. 3 is an exploded view of a preferred embodiment of a return actuator of the sprinkler device of the present invention.

Various types of return actuators are well known in the art and typically make use of a two position member biased towards either position by one or more springs, usually referred to as over center springs. In the present invention, the return actuator 140 is disposed in the annular cavity 168 formed between the head 88 and housing 18, as shown in FIGS. 2*a* and 2*b*. Referring to FIG. 3, the return actuator 170 has a pivoting arm or member 172 pivotally coupled to the housing 18, head 88, and/or shaft 102. The housing 18 has an annular protrusion 174 formed around the shaft 102, and about which the pivoting arm 172 pivots. The pivoting arm 172 defines an opening 178 in which the annular protrusion 174 is received. The housing 18 also has a pair of generally opposing protrusions 180 and 182 extending into the annular cavity 168 with the annular protrusion 174 therebetween. Each protrusion 180 and 182 has a bearing face 184 with a pair of indentations 186 and 187 formed therein. The pivoting arm 172 has a pair of resilient wings or fingers 188 and 190 formed on opposite sides. Each wing 188 and 190 extends into one of the indentations 186 or 187 formed on one of the protrusions 180 or 182. Thus, the wings 188 and 190 extending into the indentations 186 or 187 act as a two position detent.

The pivoting arm 172 also has an opening 192 for receiving the pin 129 from the valve 120 and a protrusion 194 for being engaged by the pins 156 and 166 of the head 88. Thus, as the head 88 rotates, the pins 156 and 166 rotate within the annular cavity 168. When the head 88 reaches the end of its rotational travel, one of the pins 156 or 166 engages the protrusion 194 and causes the pivoting arm 172 to pivot. Because the pin 129 of the valve 120 is engaged by the opening 192 in the pivoting arm 172, the pivoting arm 172 displaces the pin 129 of the valve 120, thus opening the valve. In addition, the wings or fingers 188 and 190 deflect inwards as the arm 172 turns and extend outwardly again into one of the other indentations 186 or 187, thus holding the arm 172 in place. Similarly, when the head 88 again reaches the end of its rotational travel, the other pin 156 or 166 engages the protrusion 194, causing the arm 172 to pivot, and the pin 129 of the valve 120 to be released, thus closing the valve 120. The wings or fingers 188 and 190 again deflect inwardly as the arm 172 turns and extend into one of the other indentations 186 or 187, thus holding the arm 172 in place.

As indicated above, the head 88 has one or more pins 156 and 166 extending therefrom into the annular cavity 168 to engage the return actuator 140. The head 88 may have two pins, a first pin 156 for engaging the return actuator 140 to open the valve 120, and a second pin 166 for engaging the return actuator 140 to close the valve 120. The pins 156 and 166 may be removably positioned so that the nozzle may be directed towards a particular area of particular angular size. Alternatively, the head may have a single pin and rotate back and forth within a 360 degree rotation.

Figure 4:
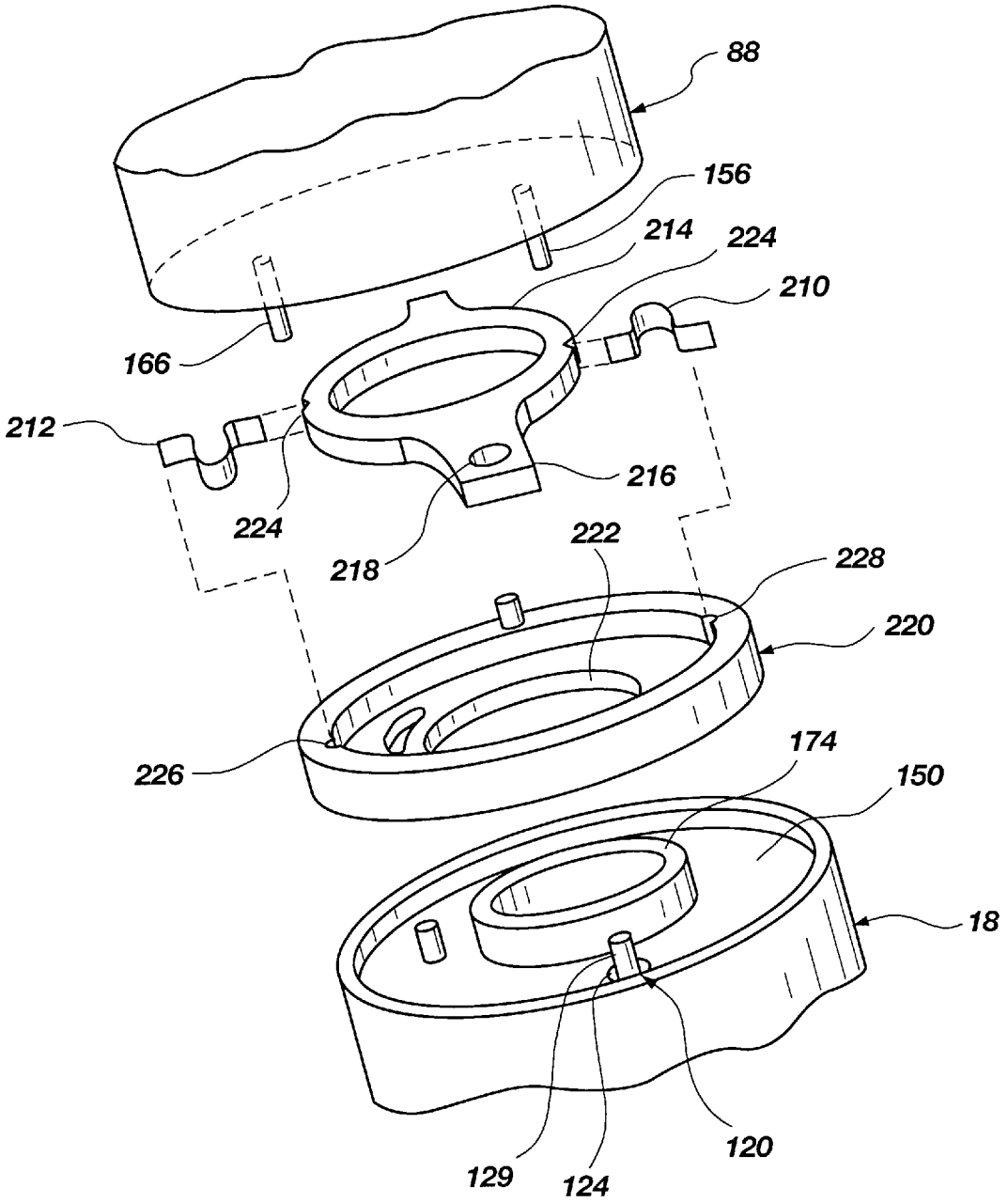
FIG. 4 is an exploded view of an alternative embodiment of a return actuator of the sprinkler device of the present invention.

Referring to FIG. 4, an alternative embodiment of a return actuator 200 is shown which utilizes over center springs 210 and 212. The return actuator 200 has a pivoting arm 214 similar to that described above. The arm 214 has a protrusion 216 with a hole 218 for receiving the pin 129 of the valve 120. The arm 214 pivots about the annular protrusion 174 of the housing 18. The actuator 200 also has a ring 220 with an opening 222 for receiving the annular protrusion 174 of the housing and pivoting thereabout. Notches 224 are formed in the arm 214 and notches 226 are formed in the ring 220 for receiving the ends of the springs 210 and 212. As the head 88 rotates, it engages and pivots the ring 220. As the ring 220 pivots, the springs 210 and 212 compress until the notches 224 and 226 align radially. The springs 210 and 212 then expand, causing the arm 214 to pivot. As the arm pivots, the pin 129 of the valve 120 is engaged and opened. The springs 210 and 212 provide a force for preventing the arm 214 and ring 220 from pivoting with respect to each other. Thus, the arm 214 continues to engage the valve 120 and maintains it in an open position.

As the head 88 rotates in the other direction and reaches the end of travel, it engages the ring 220 and causes it to pivot in the opposite direction. The force of the springs 210 and 212 is overcome and the springs are compressed until the springs expand and cause the arm 214 to pivot. As the arm pivots, it disengages the pin 129 of the valve 120, allowing the valve to close. The springs 210 and 212 again oppose pivotal movement of the ring 220 and arm 214 with respect to one another.

It is of coarse understood that the above described embodiments provide examples of many possible return actuators, many of which are well known in the art. In addition, it is understood that there are several different ways to adjust the return actuators to control the rotational movement of the nozzle, and thus the area covered. The adjustable pins may be replaced by adjustable arms which are well known in the art.

Figure 5C:
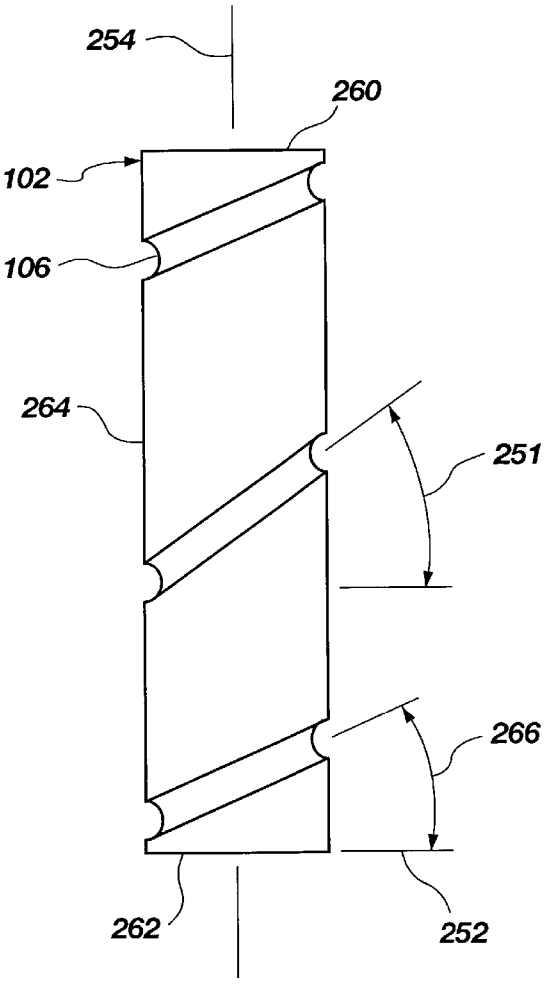
FIG. 5*c* is a side view of an alternative embodiment of a helical track of the sprinkler device of the present invention.
Figure 5B:
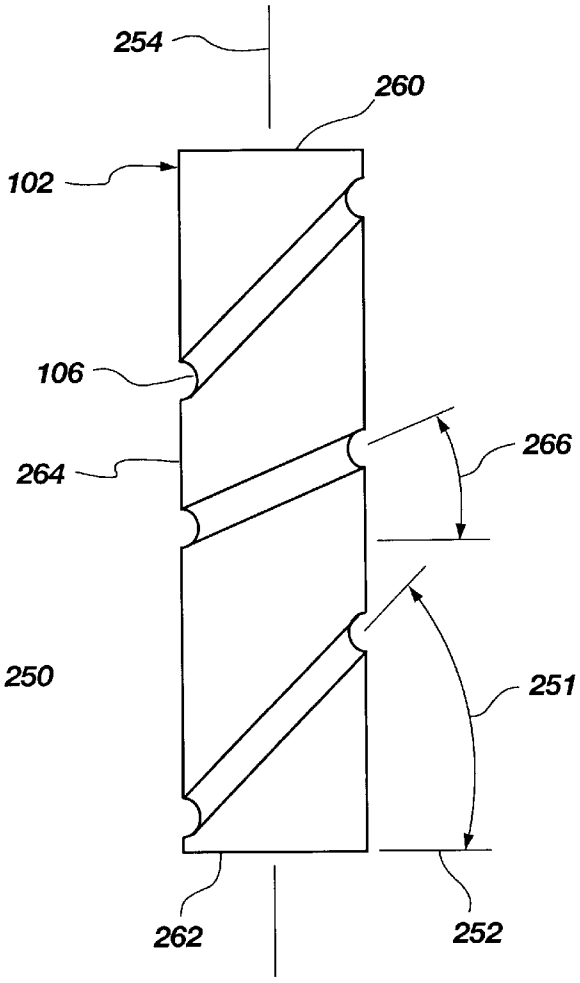
FIG. 5*b* is a side view of an alternative embodiment of a helical track of the sprinkler device of the present invention.
Figure 5A:
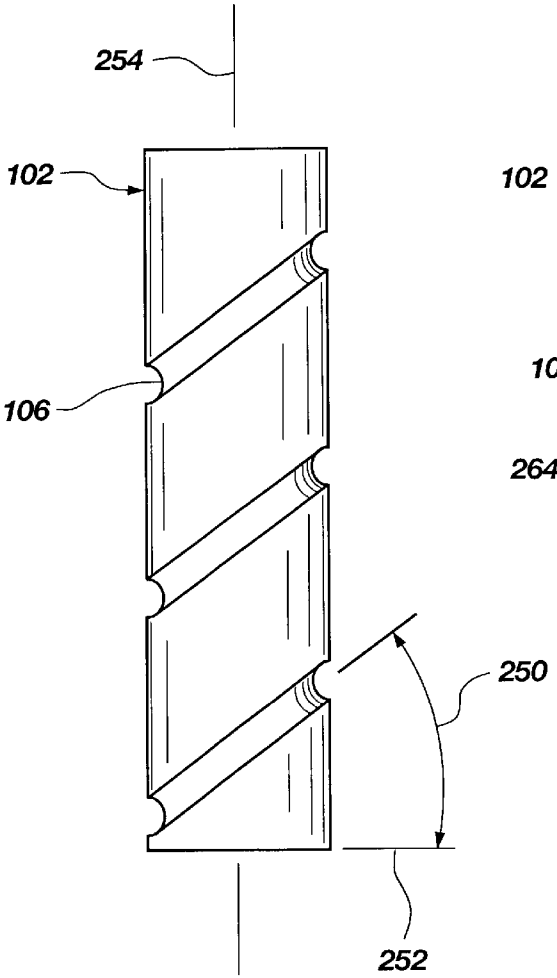
FIG. 5*a* is a side view of a preferred embodiment of a helical track of the sprinkler device of the present invention.

Referring to FIG. 5*a,* the helical track 106 formed in the shaft 102 defines a helix angle 250 with respect to a plane 252 which is perpendicular to a longitudinal axis 254 of the shaft 102. The degree of the helix angle 250 may be varied as desired. A greater or steeper helix angle 250 may be used to obtain greater torque which may be used to overcome friction. A greater helix angle, however, results in less rotational travel. A smaller helix angle 250 may be used to obtain more rotational travel of the head or nozzle. A smaller helix angle, however, will produce less torque. In addition, the helix angle may vary along the length of the shaft as desired. Referring to FIG. 5*b,* the shaft 102 may have a large helix angle 251 at ends 260 and 262 of the shaft 102, and a small helix angle 266 in middle 264 of the shaft. Such a configuration provides greater torque at the beginning of the piston travel, or stroke, to overcome friction. Referring to FIG. 5*c,* the shaft 102 may have a large helix angle 251 in the middle 264 of the shaft 102, and a smaller helix angle 266 at the ends 260 and 262. In addition, the helix angle 250 will also influence the speed at which the head or nozzle rotates. Thus, a helix angle may be selected to control the speed of rotation at various degrees of rotational travel.

Figure 6A:
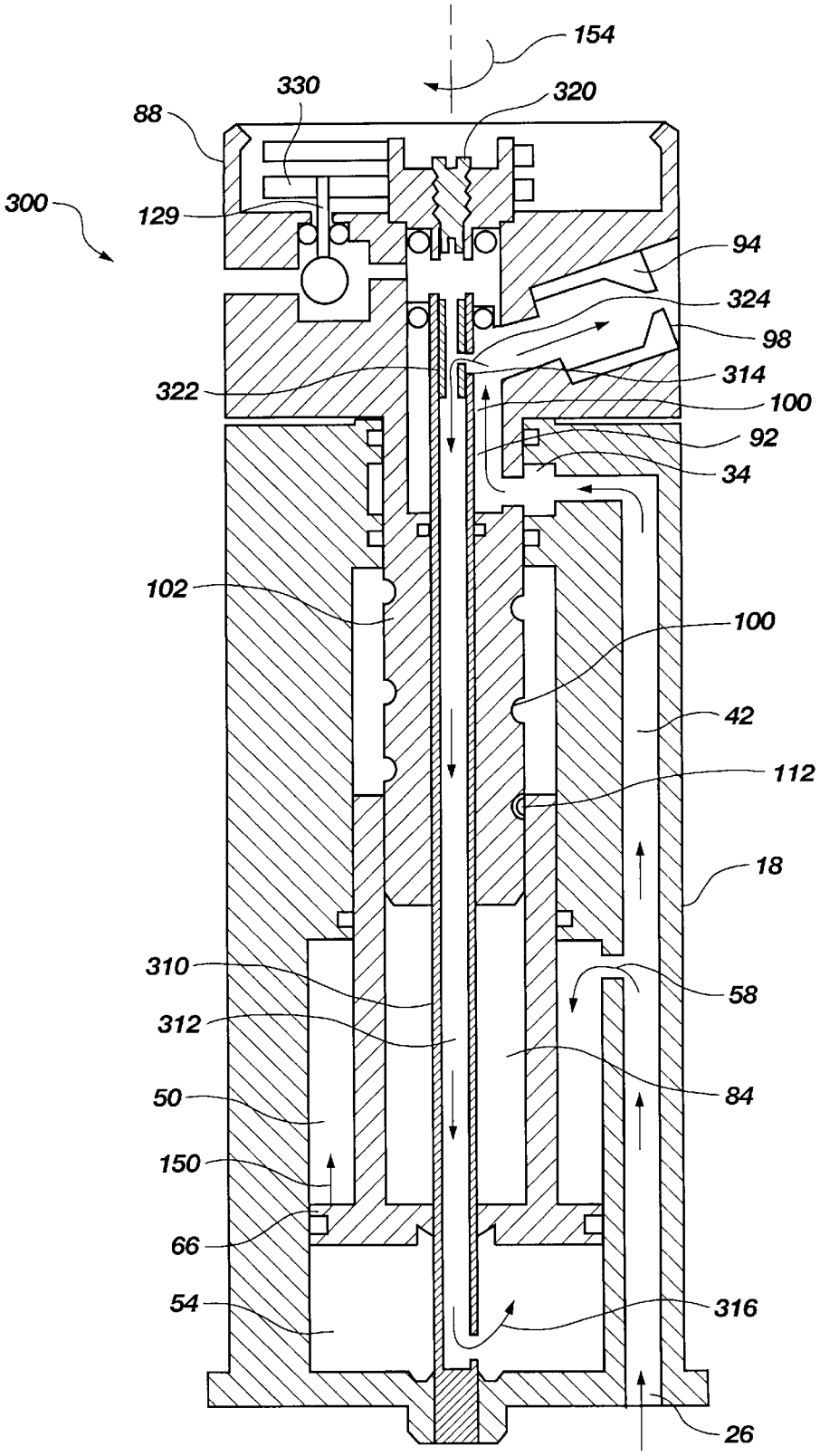
FIG. 6*a* is a cross sectional view of an alternative embodiment of a sprinkler device of the present invention.
Figure 6B:
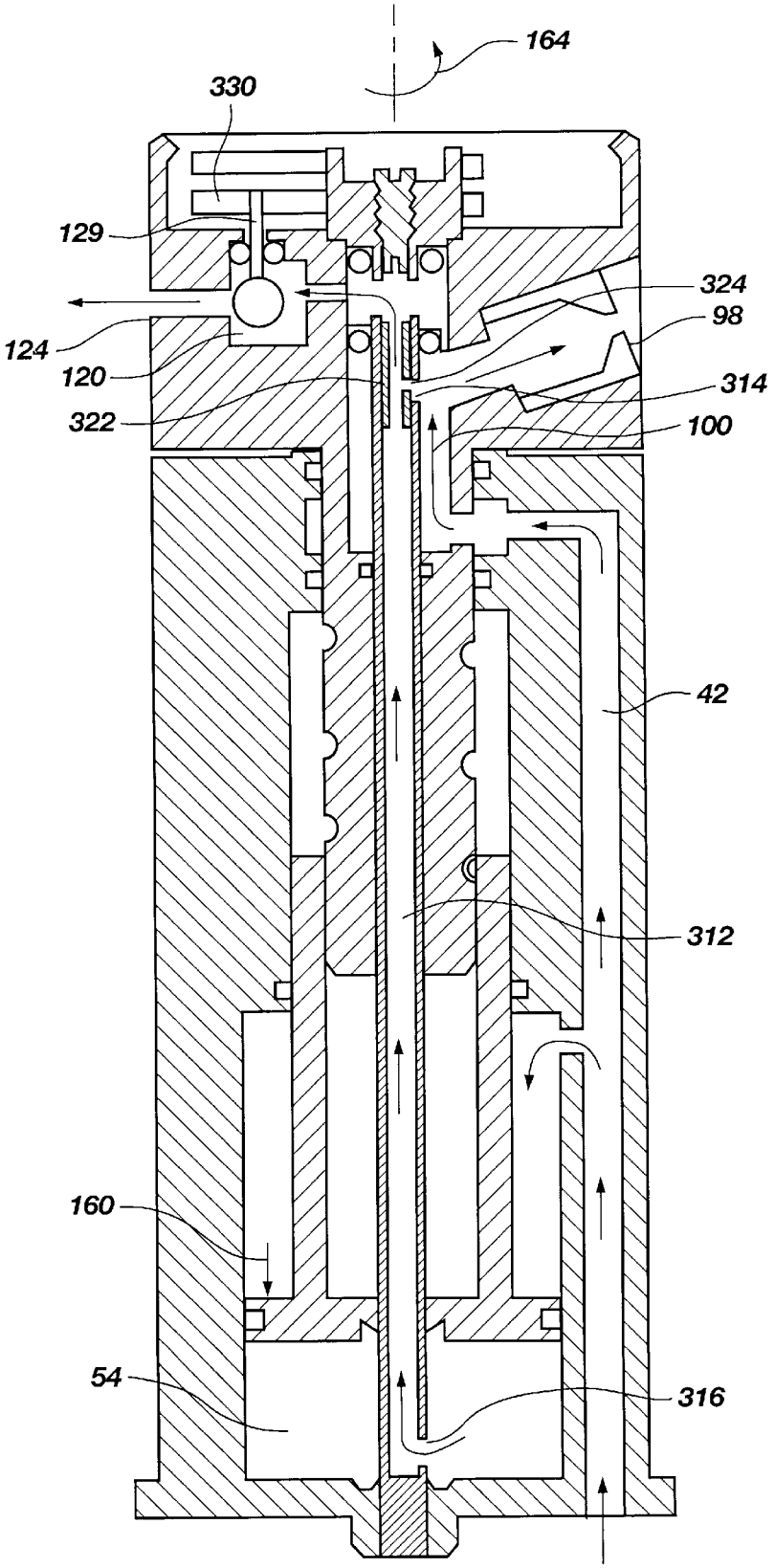
FIG. 6*b* is a cross sectional view of an alternative embodiment of the sprinkler device of the present invention.

Referring to FIGS. 6*a* and 6*b,* an alternative embodiment of a sprinkler device 300 of the present invention is shown. While the operation and structure of the alternative device 300 is similar in many respects to the operation and structure of the preferred device 10, the alternative device 300 demonstrates other possible structures and presents additional advantages.

A fixed shaft 310 is disposed in the center of the housing 18 and is rotationally and longitudinally fixed thereto. The fixed shaft 310 also extends through the shaft 102 coupled to the head 88. The fixed shaft 310 defines a secondary channel 312 therein. The fixed shaft 310 has a first opening 314 formed near a top of the shaft in fluid communication with the fluid channel 42 formed in the housing 18. The fixed shaft 310 also has a second opening 316 formed near a bottom of the shaft in fluid communication with the second chamber 54. Thus, water flows through the fluid channel 42 as before, but some of the water flows through the secondary channel 312 in the shaft and into the second chamber 54. Therefore, the secondary channel 312 is removed from the housing 18 to allow the piston 66 to be as large as possible for providing more force.

An adjustable valve 320 extends into the fixed shaft 310 from the upper end. The adjustable valve 320 is a screw type valve with a threaded portion engaging a threaded portion of the fixed shaft 310. The valve 320 has a tubular body 322 with an outer diameter sized to fit snugly within an inner diameter of the fixed shaft 310. An angular opening 324 is formed in the tubular body 322. As the tubular body 322 is rotated, and advanced or withdrawn by the threads, the angular opening 324 of the valve 320 is aligned with the first opening 314 of the fixed shaft 310. The tubular body 322 may be rotated and/or advanced such that the opening formed by the fixed tube 310 and valve 320 varies in size by varying the alignment of the angular opening 324 of the tubular body 322 with the first opening 314 of the fixed shaft 310. Thus, the amount of water entering the second chamber 54 may be varied and controlled, thus adjusting the speed of the piston and rotation of the head 88. The location of the valve 320 at the top of the head 88 makes the valve 320 more accessible and easier to adjust.

The operation of the sprinkler device 300 is similar to that described above. Referring to FIG. 6*a,* the water enters the sprinkler housing 18 through the inlet 26 and flows through the fluid channel 42. Most of the water follows the primary fluid path directly through the fluid channel 42 and out the outlet 34. Most of the water continues to follow the primary fluid path through the inlet 92 of the head 88, through the fluid channel 100 in the head 88, and out the outlet 98.

Some of the water passes through the first passage 58 and into the first chamber 50. Some of the water passes through the opening 314 in the fixed shaft 310, and into the secondary fluid channel 312. In the secondary channel 312 the water passes through the adjustable valve 320, and into the second chamber 54. This state of the sprinkler device 300 defines a pressure cycle. The water in the chambers 50 and 54 causes the piston 66 to move in the first linear direction 150, or upwardly.

As the piston 66 moves in the first linear direction, the shaft 102 is caused to rotate in the first rotational direction 154 because of the helical track 106 and tracking element 112.

Referring to FIG. 6*b,* as the head 88 nears the end of its rotational travel, a return actuator 330, as is well known in the art, engages the pin 129 of the valve 120, opening the valve.

Most of the water continues to be channeled through the housing 18 by the fluid channels 42 and 100 and dispersed by the nozzle 98 as described above. But with the valve 120 open, the water in the second chamber 54 is now allowed to flow out of the second chamber 54 through the opening 316, up the secondary channel 312, and out the opening 124 in the valve 120. In addition, the water flowing from the fluid channel 42, through the opening 314 in the shaft and the opening 324 in the tubular member 322, is now diverted out of the secondary channel 312 by the open valve 120, and thus prevented from reaching the secondary chamber 54. This state of the sprinkler device defines an exhaust cycle. The water pressure causes the piston 66 to move in the second linear direction 160, or downwardly. As the piston 66 moves in the second linear direction 160, the shaft 102 is caused to rotate in the second rotational direction 164. Referring again to FIG. 6*a,* as the head 88 nears the end of its rotational travel, the return actuator 330 disengages the pin 129 of the valve 120, closing the valve.

Referring again to FIG. 1, the sprinkler device 10 may have a drain hole 331 formed in the bottom 30 of the housing 18 and in fluid communication with the chamber 46. A flexible plate or flap 332 may be attached to the bottom 30 of the housing 18 and have a movable portion 333 located to cover the drain hole 331. When water enters the outer housing 14, the pressure of the water acts on a surface of the movable portion 333 of the flap 332, pressing it against the drain hole 331 and preventing water from exiting the housing 18 therethrough. When not in operation, however, the water which remains in the chamber 46 may drain through the drain hole 331. Thus, water is prevented from remaining in the housing 18 were it may freeze and damage the device 10.

In addition, a small fluid passage (not shown) may be formed in the piston 66 between the first surface 70 and the second surface 74. The passage is small enough not to interfere with the operation of the device 10. When not in operation, however, the passage allows water to drain from the first chamber 50 into the second chamber 54, and then out of the drain hole 331.

It is to be understood that the described embodiments of the invention are illustrative only, and that modifications thereof may occur to those skilled in the art. For example, the helical track may be formed on the exterior surface of a shaft or the internal surface of a cavity, while the shaft or cavity may be fixedly coupled to the head or the piston. Accordingly, this invention is not to be regarded as limited to the embodiments disclosed, but is to be limited only as defined by the appended claims herein.

What is claimed is:

1. A sprinkler device for dispensing pressurized water for plant life, the device comprising:

a sprinkler housing having an inlet, an outlet, and an intermediate fluid passageway disposed therebetween configured for conveying the water through the sprinkler housing;

spray means in fluid communication with the fluid passageway configured for spraying the water;

a reciprocating piston slidably disposed in the housing and configured for being acted upon by the water to impart linear reciprocal motion to the piston;

rotating means comprising a helical track and tracking element disposed between the piston and spray means for converting the linear reciprocal motion of the piston to rotational motion of the spray means; and a return actuator coupled to the rotating means for reversing directional movement of the piston to enable the reciprocal motion.

2. The device of claim 1, wherein the sprinkler housing defines a chamber; wherein the piston is disposed in the chamber and divides the chamber into a first chamber and a second chamber; and wherein the piston has a first surface in communication with the first chamber and a second surface in communication with the second chamber, the second surface having an effective surface area greater than an effective surface area of the first surface, whereby the pressurized water causes the piston to move in a first direction.

3. The device of claim 2, wherein the sprinkler housing defines:

a first fluid passage between the fluid channel and the first chamber configured for allowing the water into and out of the first chamber;

a second fluid passage between the fluid channel and the second chamber configured for allowing the water into and out of the second chamber; and further comprising:

a valve disposed in the fluid channel and configured for releasing water from the fluid channel, whereby the pressurized water and the release of water from the fluid channel causes the piston to move in a second direction; wherein the return actuator is operatively coupled to the rotating means and the valve for opening the valve while the rotating means rotates in one rotational direction and closing the valve while the rotating means rotates in another rotational direction.

4. The device of claim 3, further comprising a flow adjustment means disposed in the fluid channel for adjustably restricting the flow into the second chamber, to thereby control a rate at which fluid flows into the second chamber and a speed at which the piston moves in the first direction.

5. The device of claim 1, wherein the rotating means includes a shaft having the helical track formed in an exterior surface thereof, the shaft extending into a cavity in the piston and being rotatably disposed therein, but longitudinally fixed with respect to the housing; and wherein the tracking element is formed on the piston; and further comprising a sprinkler head rotatably disposed on the sprinkler housing, the shaft being coupled to the head.

6. The device of claim 5, wherein the helical track formed in the shaft makes one complete revolution around the shaft so that the head makes one complete revolution.

7. The device of claim 5, wherein the helical track formed in the shaft makes less than one complete revolution around the shaft so that the head makes less than one complete revolution.

8. The device of claim 5, wherein the helical track formed in the shaft makes more than one complete revolution around the shaft so that the head makes more than one complete revolution.

9. The device of claim 5, wherein the helical track formed in the shaft defines a helix angle with respect to a plane which is perpendicular to a longitudinal axis of the shaft, the helix angle being greater at ends of the track than in a middle of the track to overcome friction.

10. The device of claim 5, wherein the helical track formed in the shaft defines a helix angle with respect to a plane which is perpendicular to a longitudinal axis of the shaft, and wherein the helix angle varies along the shaft to vary the rotational speed of the head.

11. The device of claim 1, wherein the spray means comprises a primary nozzle oriented and configured for spraying water at a distance further away from the housing, and a secondary nozzle oriented and configured for spraying water nearer the housing.

12. A sprinkler device for dispensing pressurized water for plant life, the device comprising:

a sprinkler housing having an inlet, an outlet, a fluid channel disposed therebetween and configured for conveying the water through the housing, the housing defining a cavity therein in fluid communication with the fluid channel;

spray means in fluid communication with the fluid channel configured for spraying the water;

a shaft coupled to the spray means and extending into the housing, the shaft including a helical track formed at an exterior surface of the shaft;

a piston slidably disposed in the cavity of the housing and configured for being acted upon by the water to impart reciprocal linear motion to the piston, the piston having a tracking element coupled to the piston and engaging the helical track, the tracking element forcing the shaft, and thus the spray means, to rotate as the tracking element moves in a reciprocal linear motion with the piston; and a return actuator coupled to the shaft for reversing directional movement of the piston to enable the reciprocal motion, to thereby use the water to drive the piston and convert the linear motion of the piston to rotational motion of the spray means, to thereby dispense the water.

13. The device of claim 12, wherein the sprinkler housing defines a chamber; wherein the piston is disposed in the chamber and divides the chamber into a first chamber and a second chamber; and wherein the piston has a first surface in communication with the first chamber and a second surface in communication with the second chamber, the second surface having an effective surface area greater than an effective surface area of the first surface, whereby the pressurized water causes the piston to move in a first direction.

14. The device of claim 13, wherein the sprinkler housing defines:

a first fluid passage between the fluid channel and the first chamber configured for allowing the water into and out of the first chamber;

a second fluid passage between the fluid channel and the second chamber configured for allowing the water into and out of the second chamber; and further comprising:

a valve disposed in the fluid channel and configured for releasing water from the fluid channel, whereby the pressurized water and the release of water from the fluid channel causes the piston to move in a second direction; wherein the return actuator is operatively coupled to the head and the valve for opening the valve while the head rotates in one rotational direction and closing the valve while the head rotates in another rotational direction.

15. The device of claim 14, further comprising a flow adjustment means disposed in the housing fluid channel for adjustably restricting the flow into the second chamber, to thereby control a rate at which fluid flows into the second chamber and a speed at which the piston moves in the first direction.

16. The device of claim 12, further comprising a sprinkler head rotatably disposed on the sprinkler housing, the shaft being coupled to the head.

17. The device of claim 16, wherein the helical track formed in the shaft makes one complete revolution around the shaft so that the head makes one complete revolution.

18. The device of claim 16, wherein the helical track formed in the shaft makes less than one complete revolution around the shaft so that the head makes less than one complete revolution.

19. The device of claim 16, wherein the helical track formed in the shaft makes more than one complete revolution around the shaft so that the head makes more than one complete revolution.

20. The device of claim 16, wherein the helical track formed in the shaft defines a helix angle with respect to a plane which is perpendicular to a longitudinal axis of the shaft, the helix angle being greater at ends of the track than in a middle of the track to overcome friction.

21. The device of claim 16, wherein the helical track formed in the shaft defines a helix angle with respect to a plane which is perpendicular to a longitudinal axis of the shaft, and wherein the helix angle varies along the shaft to vary the rotational speed of the head.

22. The device of claim 12, wherein the spray means comprises a primary nozzle oriented and configured for spraying water at a distance further away from the housing, and a secondary nozzle oriented and configured for spraying water nearer the housing.

23. A sprinkler device for dispensing water for plant life, the device comprising:

an elongated sprinkler housing having a housing inlet, a housing outlet, and a housing fluid channel disposed therebetween configured for channeling the water through the housing, the housing defining a chamber therein in fluid communication with the housing fluid channel and configured for receiving the water;

a sprinkler head rotatably disposed on the housing and having a head inlet in fluid communication with the housing outlet, a head outlet configured for dispersing the water, and a head fluid channel disposed therebetween configured for channeling the water through the head;

an elongated shaft coupled to the head and extending therefrom into the housing, the shaft including a helical track formed on an exterior surface of the shaft;

a piston slidably disposed in the chamber of the housing configured for being acted upon by the water to impart reciprocal linear motion, the piston defining a cavity therein for movably receiving the shaft, the piston having a tracking element formed thereon and engaging the helical track of the shaft, the tracking element and helical track forcing the shaft, and thus the head, to rotate as the piston reciprocates; and a return actuator coupled to the head for reversing directional movement of the piston to enable the reciprocal motion, thereby using the water to drive the piston and converting the reciprocal linear motion of the piston to rotational motion of the head, thereby dispersing the fluid.

24. The device of claim 23, wherein the piston divides the chamber of the housing into a first chamber and a second chamber; and wherein the piston has a first surface in communication with the first chamber and a second surface in communication with the second chamber, the second surface having an effective surface area greater than an effective surface area of the first surface, whereby the pressurized water causes the piston to move in a first direction.

25. The device of claim 24, wherein the sprinkler housing defines:

a first fluid passage between the fluid channel and the first chamber configured for allowing the water into and out of the first chamber;

a second fluid passage between the fluid channel and the second chamber configured for allowing the water into and out of the second chamber; and further comprising:

a valve disposed in the fluid channel and configured for releasing water from the fluid channel, whereby the pressurized water and the release of water from the fluid channel causes the piston to move in a second direction; wherein the return actuator is operatively coupled to the head and the valve for opening the valve while the head rotates in one rotational direction and closing the valve while the head rotates in another rotational direction.

26. The device of claim 25, further comprising a flow adjustment means disposed in the housing fluid channel for adjustably restricting the flow into the second chamber, to thereby control a rate at which fluid flows into the second chamber and a speed at which the piston moves in the first direction.

27. The device of claim 23, wherein the helical track formed in the shaft makes one complete revolution around the shaft so that the head makes one complete revolution.

28. The device of claim 23, wherein the helical track formed in the shaft makes less than one complete revolution around the shaft so that the head makes less than one complete revolution.

29. The device of claim 23, wherein the helical track formed in the shaft makes more than one complete revolution around the shaft so that the head makes more than one complete revolution.

30. The device of claim 23, wherein the helical track formed in the shaft defines a helix angle with respect to a plane which is perpendicular to a longitudinal axis of the shaft, the helix angle being greater at ends of the track than in a middle of the track to overcome friction.

31. The device of claim 23, wherein the helical track formed in the shaft defines a helix angle with respect to a plane which is perpendicular to a longitudinal axis of the shaft, and wherein the helix angle varies along the shaft to vary the rotational speed of the head.

32. The device of claim 23, further comprising a primary nozzle coupled to the head and in fluid communication with the head channel, the primary nozzle being oriented and configured for spraying water at a distance further away from the housing, and a secondary nozzle coupled to the head and oriented and configured for spraying water nearer the housing.

* * * * *